US005930835A

United States Patent [19]

Silvestri

[11] Patent Number: 5,930,835

[45] Date of Patent: Aug. 3, 1999

[54] DEVICE FOR THE PRACTICE OF SNOWBOARDING AND CARVING

[75] Inventor: Andrea Silvestri, Genova, Italy

[73] Assignee: HTM Sport S.p.A., Italy

[21] Appl. No.: 09/058,243

[22] Filed: Apr. 10, 1998

[30] Foreign Application Priority Data

May 7, 1997 [IT] Italy ..... GE97A0040

[51] Int. Cl.[6] ..... A63C 11/22

[52] U.S. Cl. ..... 2/16; 280/821

[58] Field of Search ..... 2/16, 20, 159, 2/161.1, 17, 18; 280/819, 821, 822

[56] References Cited

U.S. PATENT DOCUMENTS

| | | | |
|---|---|---|---|
| D. 340,497 | 10/1993 | Brewer | D21/230 |
| 3,746,356 | 7/1973 | Shipstad | 280/11.37 H |
| 3,874,686 | 4/1975 | Shipstad et al. | 280/11.37 H |
| 4,024,863 | 5/1977 | Ball | 2/16 |
| 4,351,526 | 9/1982 | Schwartz . | |
| 4,572,545 | 2/1986 | Dooley et al. | 2/16 |
| 4,657,282 | 4/1987 | Kock | 280/821 |
| 4,854,575 | 8/1989 | Wilson et al. . | |
| 5,375,262 | 12/1994 | Cuccia | 2/161.1 |

FOREIGN PATENT DOCUMENTS

| | | |
|---|---|---|
| 4004826 | 2/1990 | Germany . |
| 629 108 | 4/1982 | Switzerland . |

*Primary Examiner*—John J. Calvert
*Assistant Examiner*—Tejash D Patel
*Attorney, Agent, or Firm*—Larson & Taylor

[57] ABSTRACT

A device for support and protection in the practice of snowboarding and carving. An essentially ellipsoidal shaped element has a holding structure arranged within the element and essentially parallel to its main axis.

9 Claims, 4 Drawing Sheets

DEVICE FOR THE PRACTICE OF SNOWBOARDING AND CARVING

BACKGROUND OF THE INVENTION

The present invention relates to a device for the practice of snowboarding and carving.

Recently, the very widespread practice of alpine skiing has been joined by similar practices which are essentially different as far as the equipment used is concerned and, consequently, in the results obtained by the practitioners. The practice of snowboarding, which essentially transfers the characteristics of water surfing to snow and in particular to off-piste snow, is fairly widespread. Also experiencing rapid growth, however, is carving, a practice which is characterized by the use of shorter, more waisted skis on which it is possible to follow curved trajectories with increasingly shorter arcs at very low speeds. Both disciplines are distinguished by the fact that it is possible not to use the ski poles which conventionally provide support and balance in the practice of alpine skiing.

This feature means, however, that there is a lack of any effective support element, other than the fact that the sportsperson can use his own hands as balancing means. Clearly, this technique is neither very effective nor very safe as it exposes the hands and the wrists to violent stresses and makes use of a small surface which is not suited to sliding.

SUMMARY OF THE INVENTION

It is therefore the aim of the present invention to provide a support and pivoting device which allows the best possible control of trajectories with the most extreme curvatures and at the same time provides adequate protection for the hands of the user.

The present invention therefore relates to a support and protection device for the practice of snowboarding and carving, characterized in that said device comprises an essentially ellipsoidally shaped element provided with holding means arranged parallel to the axis of said element.

In one embodiment of the present invention, said device comprises an ellipsoidal element provided with a cavity which is accessible via a suitable opening and inside which holding means coaxial with said element are provided.

Advantageously, said element is essentially ovoidally shaped and provided on at least one of its two polar caps with friction means.

BRIEF DESCRIPTION OF THE DRAWINGS

Further advantages and characteristics of the present invention will become more clear from the following detailed description of an embodiment of the same which is given simply by way of non-limiting example with reference to the attached drawings, in which.

DESCRIPTION OF THE PREFERRED EMBODIMENT OF THE INVENTION

Figure 1:
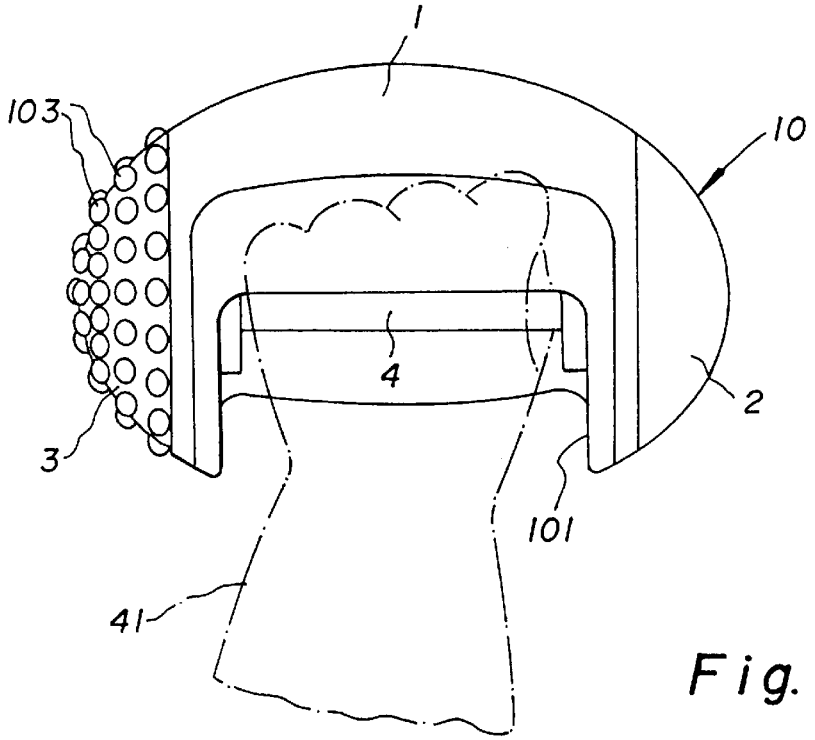
FIG. 1 is a view in elevation of the device according to the present invention.

In FIG. 1, the device according to the present invention, indicated by number 10, is illustrated. Reference number 1 designates the middle section of an essentially ellipsoidal, internally hollow element, the internal cavity of which is accessible through the opening 101. At the two polar ends, said element has two caps 2 and 3 which project convexly out from the middle section 1. In particular, the cap 3 has the surface from which the hemispherical protuberances 103 project. Arranged inside the cavity of the element 1, coaxially with said element, is a holding means in the form of a handle 4 which can be gripped easily, as illustrated, by the hand 41 which is drawn in broken lines in the figure.

Figure 2:
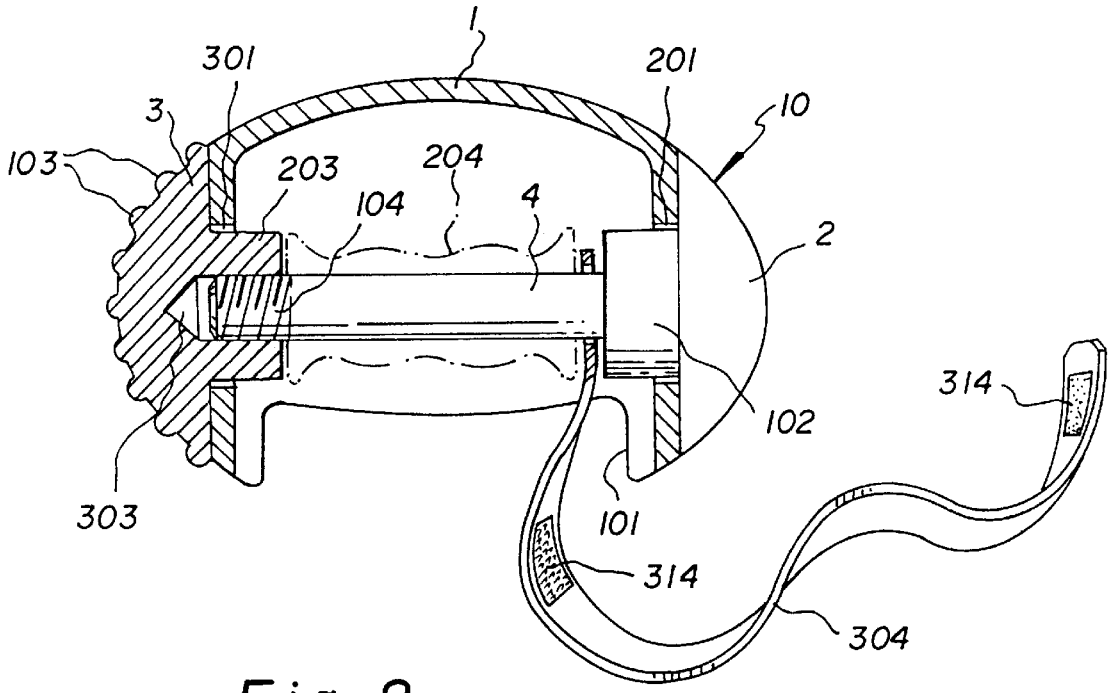
FIG. 2 is a view in longitudinal section of the device according to the present invention.

The device according to the invention is illustrated in section in FIG. 2. The middle section of element 1 takes the form of an ellipsoidal segment provided at its two ends with two axial holes 201 and 301. The tang 102 of the cap 2, from which the handle 4 extends axially, is inserted into the hole 201, said handle being made in one piece with said tang 102. The free end 104 of the handle 4 is provided with a thread for connection to the threaded cavity 303 of the tang 203 which extends axially from the cap 3. The handle 4 is also provided with an anatomically contoured covering 204 and connected to this is a strap 304 provided with hook and loop fastener strips 314 for fastening around the wrist of the user.

Figure 3:
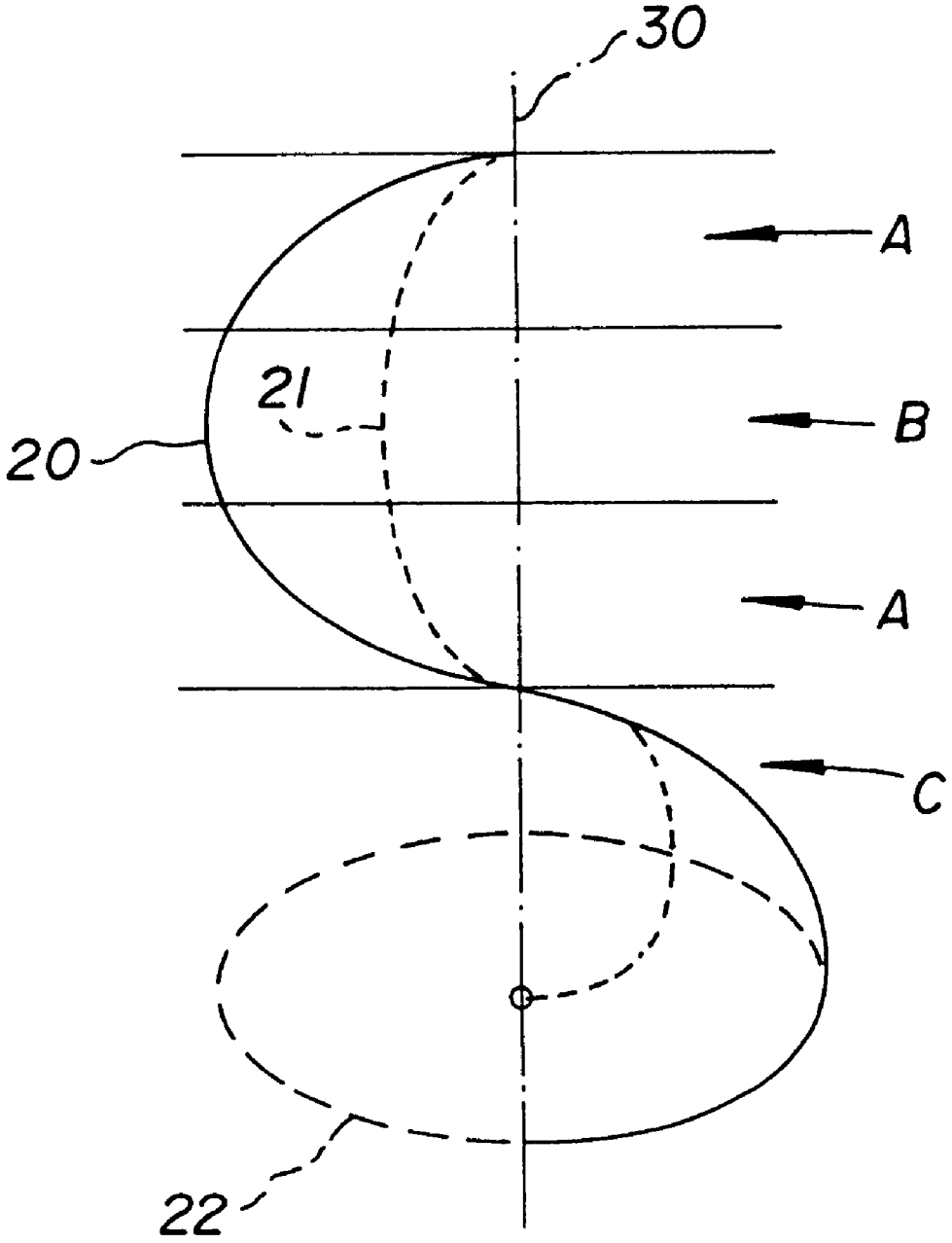
FIG. 3 is a schematic diagram of the movement of the user of the device of the invention.

The functioning of the device according to the present invention will be clear from the following, with reference to FIGS. 3 to 5C. FIG. 3 is a diagrammatic illustration of an example of a curved path followed in the practice of carving. The continuous curve 20 represents the course of the skis while the curve 21 consisting of small dashes represents the course of the device of the invention. The vertical line 30 represents the line of maximum gradient while the sectors A, B and A into which the drawing is divided distinguish the successive phases of the movement of the skier during the run. The curve 22 consisting of large dashes and the sector C of the diagram in FIG. 3 represent a possible further phase of the movement of the skier.

When the skier starts to describe the curve of the path 20, he leans with his inner arm on the device 10. In this position, as emerges from FIGS. 4A and 5A, the arm is essentially close to the body, with an angle of inclination in relation to the sliding plane of approximately 90°, and the surface of the device slides over the sliding surface, in other words the snow-clad inclined plane.

Figure 4A:
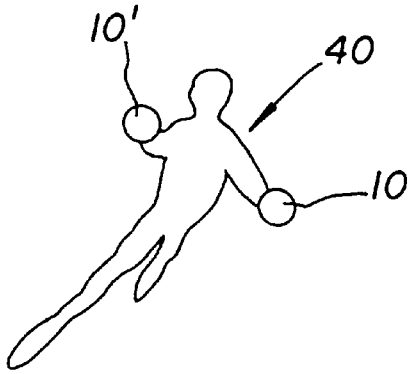
FIGS. 4A to 4C illustrate diagrammatically the different positions adopted by the user during the various phases of the movement illustrated in the diagram in FIG. 3, and FIGS. 5A to 5C illustrate the different positions of the device in the phases of movement in FIG. 3.
Figure 4B:
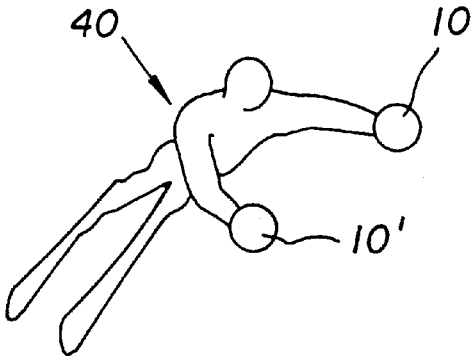

As the curvature of the path increases, that is to say on passing from phase A to phase B, the skier moves the device away from his body and at this point his arm has an angle of inclination of between 0 and 45° in relation to the sliding plane. The device continues to slide over the sliding surface, providing the necessary support for the skier. Moreover, as illustrated in FIG. 4B, in this second phase, the skier can if necessary rely on the additional support provided by the device 10' held by the outer arm.

The following phase of return towards the line 30 of maximum slope is a phase A again, in other words a phase in which the skier moves the device 10 towards the body again. Without interruption, a new curve can be started on the opposite side in relation to the line of maximum gradient, with the same sequence of phases.

Figure 4C:
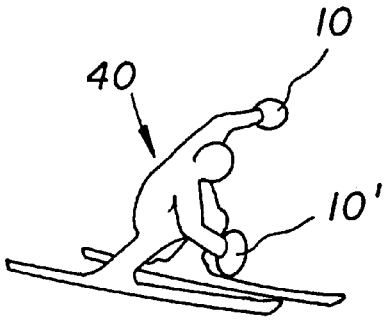
Figure 5A:
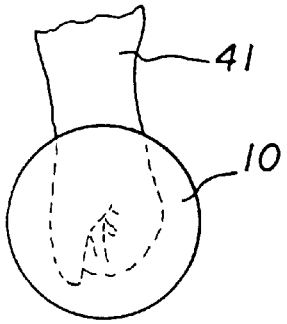
Figure 5B:
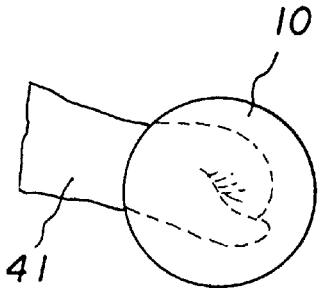
Figure 5C:
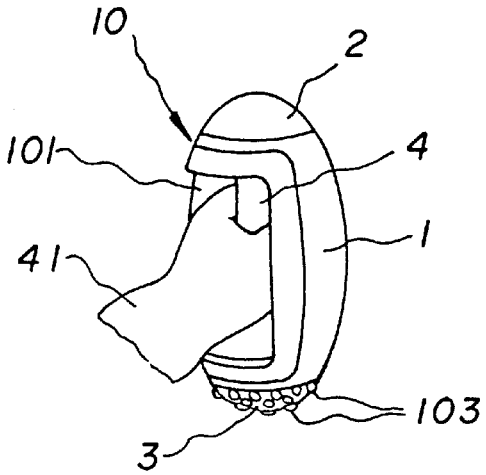

In addition to the moderately gentle curve which is obtained, as described above, by the succession of phases A, B and A, the skier can also produce much sharper curves, up to 360°, by implementing the technique illustrated diagrammatically in phase C in FIG. 3. In practice, in this phase the device, which in the phases previously described has been used with its axis parallel to the sliding plane, is rotated, as can be seen in FIGS. 4C and 5C, so that the cap 3 provided with the protuberances 103 is towards the snow-clad surface. This movement slows the movement of the skier and allows the latter to pivot on the device 10 to perform manoeuvres of the type illustrated diagrammatically in FIG. 3.

The device designed in this manner therefore allows optimum control and makes it possible to take full advantage of the acrobatic characteristics of carving skis, at the same time serving as protection for the hands of the skier.

I claim:

1. A device for the practice of snowboarding and carving, the element comprising an essentially ellipsoidally shaped element, comprising:

a middle section having a main axis a holding means arranged substantially parallel to the main axis of the element, an opening for receive receiving a hand for gripping the holding means, and a pair of opposed end caps which project convexly out from the middle section and are constructed for engagement with and sliding and slide over a snow clad surface.

2. A device according to claim 1, in which the element is provided on a surface of at least one of the two end caps with friction and pivoting means.

3. A device according to claim 2, in which said friction and pivoting means comprises a plurality of generally hemispherical protuberances projecting outwardly from the surface of the end cap.

4. A device according to claim 1, the element being formed with a hollow cavity which is accessible via said opening, and said holding means located inside the cavity and being essentially coaxial with the element.

5. A device according to claim 4, in which said middle section comprises an ellipsoidal segment having ends on which the opposed end caps are connected.

6. A device according to claim 5, in which said ellipsoidal segment has axial holes at the opposite ends and in which said opposed end caps are each provided with a tang matching one of said axial holes, said holding means being integral at one end with one of the caps and connectable at the other end to the tang of the other cap.

7. A device according to claim 6, in which said holding means comprises an anatomically contoured tubular covering element.

8. A device according to claim 7, including a securing structure for securing said device to a wrist.

9. A device according to claim 8, in which said securing structure comprises a strap provided with hook and loop fastener strips for fixing the strap to the wrist.

* * * * *